US005334999A

United States Patent [19]

Kashiwazaki et al.

[11] Patent Number: 5,334,999

[45] Date of Patent: Aug. 2, 1994

[54] DEVICE FOR PREPARING INK JET RECORDING HEAD WITH CHANNELS CONTAINING ENERGY GENERATING ELEMENTS

[75] Inventors: Akio Kashiwazaki; Masatsune Kobayashi, both of Yokohama; Ryuichi Arai, Tokyo; Junichi Kobayashi, Ayase; Akihiko Shimomura, Yokohama, all of Japan

[73] Assignee: Canon Kabushiki Kaisha, Tokyo, Japan

[21] Appl. No.: 778,668

[22] Filed: Oct. 18, 1991

[30] Foreign Application Priority Data

| | | | |
|---|---|---|---|
| Oct. 18, 1990 | [JP] | Japan | 2-277838 |
| Jul. 5, 1991 | [JP] | Japan | 2-165410 |
| Jul. 5, 1991 | [JP] | Japan | 3-165411 |
| Oct. 4, 1991 | [JP] | Japan | 3-257663 |

[51] Int. Cl.[5] ..... B41V 2/05

[52] U.S. Cl. ..... 347/65; 29/890.1; 430/320; 347/45

[58] Field of Search ..... 346/140 R, 1.1; 430/320, 328, 330; 29/890.1

[56] References Cited

U.S. PATENT DOCUMENTS

| | | | |
|---|---|---|---|
| 3,954,475 | 5/1976 | Bonham et al. | 96/67 |
| 3,984,253 | 10/1976 | Nelson | 430/325 X |
| 4,312,934 | 1/1982 | Rice | 430/320 X |
| 4,313,124 | 1/1982 | Hara . | |
| 4,345,262 | 8/1982 | Shirato et al. . | |
| 4,412,224 | 10/1983 | Sugitani | 346/1.1 |
| 4,459,600 | 7/1984 | Sato et al. . | |
| 4,463,359 | 7/1984 | Ayata et al. . | |
| 4,558,333 | 12/1985 | Sugitani et al. . | |
| 4,587,205 | 5/1986 | Harrah | 430/330 X |
| 4,647,523 | 3/1987 | Petermann | 430/330 X |
| 4,657,631 | 4/1987 | Noguchi | 156/655 |
| 4,723,129 | 2/1988 | Endo et al. . | |
| 4,740,796 | 4/1988 | Endo et al. . | |
| 5,030,317 | 7/1991 | Noguchi | 156/630 |

FOREIGN PATENT DOCUMENTS

| | | |
|---|---|---|
| 0220959 | 5/1987 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |
| 61-154947 | 7/1986 | Japan . |
| 1280565 | 1/1990 | Japan . |
| 2189746 | 11/1987 | United Kingdom . |

OTHER PUBLICATIONS

K. Utsumi, et al., "Drop-on-Demand Ceramic Ink-Jet Head Using Designed-Space Forming Technology,"-*NEC Research & Development,* No. 85, Apr. 1987, pp. 7-14.

J. M. Zeigler et al., Self-Developing Polysilane Deep-UV Resists-Photochemistry, Photophysics, and Submicron Lithography, *SPIE,* vol. 539, Advances in Resist Technology and Processing II (1985), pp. 166-174.

H. Ito et al., "Chemical Amplification in the Design of Dry Developing Resist Materials," *Polymer Engineering and Science,* vol. 23, No. 18, Dec. 1983 pp. 1012-1018.

C. G. Willson et al., "Approaches to the Design of (List continued on next page.)

*Primary Examiner*—Joseph W. Hartary

*Attorney, Agent, or Firm*—Fitzpatrick, Cella, Harper & Scinto

[57] ABSTRACT

A process for preparing an ink jet recording head, comprises: the step for providing a first material which is volatilized by imparting an active energy in a layer on a substrate; the step for patterning the layer of said first material by imparting said active energy to the layer of said first material corresponding to the pattern of ink channels communicated to the discharging outlet which discharges ink; the step for providing a second material so as to cover the layer of said material shaped in the pattern formed by said step; and the step for forming said ink channels by volatilization of the layer of said pattern shaped first material coated with said second material by imparting said active energy.

15 Claims, 6 Drawing Sheets

OTHER PUBLICATIONS

Radiation-Sensitive Polymeric Imaging Systems with Improved Sensitivity and Resolution," *J. Electrochem. Soc.*, vol. 133, No. 1, Jan. 1986, pp. 181-187.

H. Hiroaka et al., "Deep UV Photolithography with Composite Photoresists Made of Poly(olefin sulfones),'-'*Polymers in Electronics*, 1984, pp. 55-64.

H. Ito et al., "Thermally Developable, Positive Tone, Oxygen RIE Barrier Resist for Bilayer Lithography," *J. Electrochem. Soc.*, vol. 136, No. 1, Jan. 1989, pp. 245-249.

J. M. J. Frechet et al., "Thermally Depolymerizable Polycarbonates V. Acid Catalyzed Thermolysis of Allylic and Benzylic Polycarbonates: A New Route to Resist Imaging," *Polymer Journal*, vol. 19, No. 1, 1987, pp. 31-49.

A. Steinmann, "Heat Developable Resist for Multilayer Resist Technology," *SPIE*, vol. 920, Advances in Resist Technology and Processing V, Feb. 29-Mar. 2, 1988, pp. 13-20.

M. J. Bowden et al., "Vapor Development of Poly(Olefin Sulfone) Resists," *Polymer Engineering and Science*, vol. 14, No. 7, Jul. 1974, pp. 525-528.

M. W. Geis et al., "Nitrocellulose as a Self-Developing Resist with Subicrometer Resolution and Processing Stability," *J. Vac. Sci. Technol. B*, vol. 1, No. 4, Oct.--Dec. 1983, pp. 1178-1181.

DEVICE FOR PREPARING INK JET RECORDING HEAD WITH CHANNELS CONTAINING ENERGY GENERATING ELEMENTS

BACKGROUND OF THE INVENTION

1. Field of the Invention

This invention relates to a process for preparing an ink jet recording head, an ink jet recording head prepared by said preparation process and an ink jet recording device equipped with said head. More particularly, it pertains to a process for preparing an ink jet recording head which forms ink channels where energy generating bodies for generating the energy to be utilized for discharging ink are arranged correspondingly, the ink jet recording head prepared according to said preparation process and the ink jet recording device equipped with said head.

2. Related Background Art

A representative example of the ink jet recording head which performs recording by use of the ink jet (liquid jet) recording system, is the ink jet recording head equipped with an ink passage including the ink channels or paths where energy generating bodies for generating the energy to be utilized for discharging the ink communicated to the fine discharging outlets for discharging the ink are arranged correspondingly, and the common liquid chamber for storing the ink to be fed to the ink channels.

In the prior art, one of the known comparatively effective processes for preparing such ink jet recording heads, is one having the steps as described below in, for example, Japanese Patent Laid-open No. 61-154947 (U.S. Pat. No. 4,657,631).

(A) the step of providing a posi-type photosensitive resin layer on a substrate, effecting pattern exposure by use of a mask having a pattern corresponding to the ink passage, dissolving developing the light-irradiated portion with the use of a developer to form a solid layer corresponding to the pattern of the ink passage;

(B) the step of coating the solid layer with, for example, an active energy ray curable material or a thermosetting material, and irradiating an active ray energy from the above or applying heating, thereby curing the active energy ray curable material or the thermosetting material; and (C) the step of forming an ink channel by dissolving away the solid layer by use of a solvent.

However, in such a process for preparing an ink jet recording head of the prior art, problems have ensued as described below accompanied primarily with developing, and removal of the solid layer.

(1) Since a solvent is utilized when forming ink channels by removing the solid layer shaped in a pattern in developing the solid layer, the developing device and the removal device for handling these solvents are required.

(2) Accompanied with such devices, working steps become relatively complicated resulting in low production.

(3) When removing the pattern-shaped solid layer, the solvent comes into contact with the ink passage forming member comprising the active energy ray curable material or the thermosetting material. For this reason, the ink passage forming member may swell, or sometimes dissolve with the result that fine peel-off may sometimes be generated between the substrate and the ink passage forming member.

This will lead to lowering of the dimensional precision of the ink passage or lowering of the strength of the ink jet recording head.

Also, due to these problems, there has been a fear that such problems as irregularity of printing density because of variance of ink droplet sizes or printing deviation because of variance of ink discharging speeds may also occur.

The peripheral portion of the discharging outlet of the ink jet recording head is ordinarily applied with water repellent treatment for maintaining the good discharging state of ink, but when performing the water repellent treatment by removing the solid layer by dipping into a solvent, there have been problems in that the function of the water repellent agent coated on the discharging outlet surface was lowered by the solvent or that the water repellent agent may be sometimes be peeled off.

On the other hand, when the water repellent treatment is performed by discharging the water repellent agent from the support to the discharging outlet portion after removal of the solid layer, the water repellent agent may be sometimes penetrated from the discharging outlet into the ink passage, whereby the discharging speed of ink, the size of ink droplet, the discharging direction of ink etc. may be changed by the water repellent agent penetrated, resulting in poor performance.

SUMMARY OF THE INVENTION

One of the objects of the present invention is to solve these problems and provide a process for preparing an ink jet recording head which is high in reliability of dimensional stability, etc., and simple and good in yield and productivity, an ink jet recording head of high precision and high strength prepared according to said preparation process and an ink jet recording device equipped with said head.

Another object of the present invention is to provide a process for preparing an ink jet recording head which can apply surely the water repellent treatment at the desired site without lowering the function of the water repellent agent and also without penetrating into the ink passage, an ink jet recording head of high precision and high strength prepared according to said preparation process and an ink jet recording device equipped with said head.

Still another object of the present invention is to provide a process for preparing an ink jet recording head, comprising: the step for providing a first material which is volatilized by imparting an active energy in a layer on a substrate; the step for patterning the layer of said first material by imparting said active energy to the layer of said first material corresponding to the pattern of ink channels communicated to the discharging outlet which discharges ink; the step for providing a second material so as to cover the layer of said material shaped in the pattern formed by said step; and the step for forming said ink channels by volatilization of the layer of said pattern shaped first material coated with said second material by imparting said active energy.

Still another object of the present invention is to provide an ink jet recording apparatus, equipped with the above ink jet recording head, and a conveying means which conveys a recording medium member on which recording is performed by said ink jet recording head.

Still another object of the present invention is to provide a process for preparing an ink jet recording head, comprising: the step for providing a first material which is volatilized by imparting an active energy and heat in a layer on a substrate; the step for patterning the layer of said first material by imparting said active energy to the layer of said first material corresponding to the pattern of an ink channel communicated to the discharging outlet for discharging ink; the step for providing a second material so as to cover the layer of said first material shaped in a pattern formed by said step; and the step for forming said ink channel by volatilization of the layer of said pattern-shaped first material coated with said second material by imparting said active energy and said heat.

Still another object of the present invention is to provide an ink jet recording apparatus, equipped with the above ink jet recording head, and a conveying means which conveys a recording media member on which recording is effected by said ink jet recording head.

Also, the present invention includes an ink jet recording head prepared according to the preparation process as described above and an ink jet recording device equipped with said head.

According to the present invention, since a dry developing (or self-developing) material which is volatilized, sublimated only by imparting light or heat, preferably a dry developing (or self developing) resin material having photosensitivity is used as the material to be arranged corresponding to the pattern of the ink passage, developing and removal can be done without use of a solvent.

Therefore, according to the present invention, no large scale preparation device such as a developing device or removal device is required, and also the steps are simplified to effect improvement of workability and productivity. Further, since no solvent is required to be used, danger in production is reduced. Also, since a dry developing (or self-developing) material is used, the range of choice of the material for coating which has been narrowed in relationship with the solvent becomes wider. In addition, there will be no problem such as swelling of the ink passage wall forming member, whereby the fine peel-off problem from the substrate is solved. Hence, an ink jet recording head with high dimensional precision can be obtained with ease.

DETAILED DESCRIPTION OF THE PREFERRED EMBODIMENTS

Figure 1:
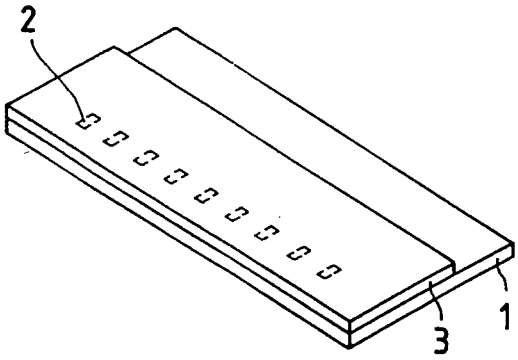
FIG. 1 is a schematic perspective view showing the state in which a first photosensitive material layer is formed on a substrate.

The present inventors have investigated intensively in order to accomplish the objects as described above, and consequently they were interested in a dry developing (or self developing) material which is volatilized or sublimated only by imparting light or heat, preferably a dry developing (or self-developing) resin material having photosensitivity. It has now been discovered that use of the above material as the material to be arranged corresponding to the pattern of the ink passage, developing and removal can be done without use of a solvent, and therefore various problems which may sometimes be generated by use of a solvent during developing and during removal as in the prior art can be solved, whereby the present invention has been accomplished.

In the following, the embodiments of the present invention are described in detail by referring to drawings.

FIG. 1 to FIG. 5 are schematic perspective views for illustration of the preparation process of the ink representative embodiments of the present invention in the order of the steps. The head according to the present invention is formed on the substrate 1 shown in FIG. 1. The substrate 1 is constituted of, for example, glass, ceramics plastic or metal, etc. which functions as a part of the liquid passage forming member of the ink as described below and as the support for the photosensitive material layer, and can be used without particular limitation of its shape material etc. provided that it can comply with the above object. In the embodiment in FIG. 1, on the above substrate 1 are arranged a predetermined number (9 in this Figure) of energy generating elements 2 which generate the energy utilized for discharging the liquid such as electro-thermal transducing elements or piezoelectric elements, etc. (however, in the case of piezoelectric elements, they are ordinarily arranged on the back side of the substrate 1). With such energy generating elements 2, the energy utilized for discharging the recording liquid as small droplets is given transferred to the ink liquid, whereby ink liquid is discharged to perform recording.

In this connection, for example, when an electro-thermal transducing element is used as the energy generating element 2, the ink liquid is discharged by heating of the recording liquid in the vicinity with this element. On the other hand, for example, when a piezoelectric element is used, the ink liquid is discharged by mechanical vibration of the element.

These energy generating elements 2 are provided with electrodes for inputting control signals (not shown) for actuating these elements 2 by connection. Also, generally for the purpose of improvement of durability of these energy generating elements, various functional layers such as protective layers, etc. are frequently provided.

As the next step, on the substrate 1 having the above energy generating elements 2 provided thereon, the layer 3 of a first material, particularly a first photosensitive material is formed. As the method for forming the first photosensitive material layer 3, a solution containing the photosensitive material dissolved therein may be coated by the solvent coating method, or alternatively a dry film having the photosensitive material coated thereon may be prepared and laminated on the substrate according to the laminating method.

The solvent coating method is a method in which the photosensitive material solution is coated on the substrate by spin coater, roll coater or wire bar, etc., followed by removal of the solvent by drying to form the photosensitive material layer. Here, in the present invention, as the first photosensitive material layer 3, for example, a resin which is volatilized by heating after irradiation of an active energy ray, etc. is used. As the photosensitive material having such property, there is one prepared by mixing a polycarbonate composed mainly of the constituent units of the following formula [I] described in Polymer Journal, 19 (1) 31 (1987):

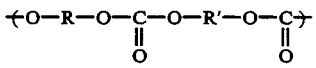

[1]

with an optical acid generating agent and dissolved in a solvent to form a liquid photosensitive material, etc. This photosensitive material is a posi-type, and when an active energy ray is irradiated, an acid is formed at the irradiated portion, and when heated under this state, the polycarbonate is decomposed and volatilized. Accordingly, the photosensitive material can remove the active energy ray irradiated portion merely by heating without use of a solvent during developing. As the polycarbonate of the above formula [I], those having the structures shown below in Table 1 can be exemplifed.

TABLE 1

| Sign | R | R' |
|---|---|---|
| a | 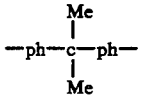 | 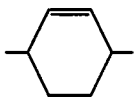 |

TABLE 1-continued

| Sign | R | R' |
|---|---|---|
| b | 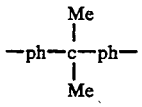 | 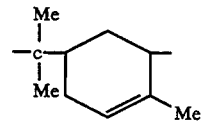 |
| c | 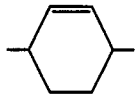 | 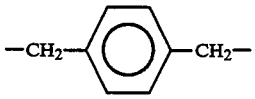 |
| d | 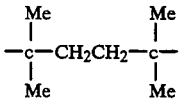 | 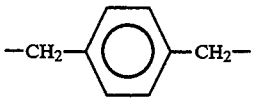 |

As the optical acid generating agent, onium salts, such as triphenylfulfonium hexafluoroacetate, triphenyliodonium hexafluorophosphate, etc., of polyhalogen compounds etc. are preferred, and their formulated amounts should be preferably made 1 to 25% by weight based on the polycarbonate. As the solvent for dissolving these, those conventionally used can be employed.

As the representative example in the present invention, a resin solution which is volatilized by heating of the above active energy ray irradiated portion is coated on the substrate 1, and then by removing the solvent, a first photosensitive material layer 3 is formed on the substrate 1. The formation of the above material layer 3 is not limited to this, as, for example, the lamination method may also be employed.

Figure 2:
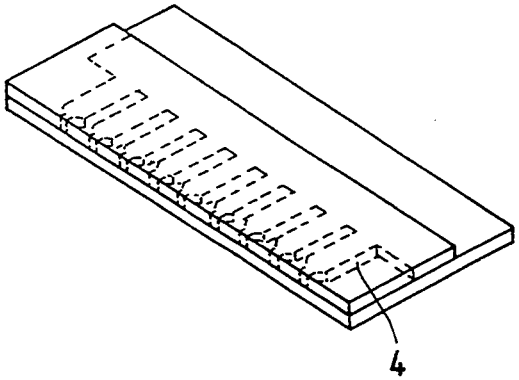
FIG. 2 is a schematic perspective view showing the state in which a pattern latent image of a solid layer is formed on the first photosensitive material layer.

The first photosensitive material layer 3 formed according to the above method is subjected to exposure at the portions other than the portion where the ink passage including the ink liquid channels the common chamber, etc. communicated to the ink discharging outlet as described below is to be formed, to obtain a pattern latent image 4 as shown in FIG. 2. In this case, as the light irradiated, an active energy ray is employed, and this includes UV-ray, far UV-ray, electron beam, radiation etc. The irradiation should by preferably continued for about 1 to 15 minutes.

Figure 3:
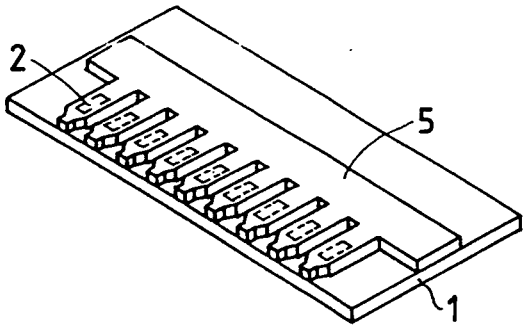
FIG. 3 is a schematic perspective view showing the state in which the pattern latent image in FIG. 2 is developed.

Subsequently, by heating the substrate 1 having the first photosensitive material layer 3 with formation of the above pattern latent image 4 laminated thereon, by volatilization removal of the portions other than the portion where the above ink passage is to be formed of the first photosensitive material layer 3, the solid layer 5 of the pattern shown in FIG. 3 is obtained. Here, as the heating temperature, which may also depend on the material employed such as polycarbonate, the kind and the thickness of the optical acid generating agent, 60° to 100° C. is preferred. And the heating time is preferably about 1 to 10 minutes. Further, heating may be performed under either normal pressure or reduced pressure.

Figure 4:
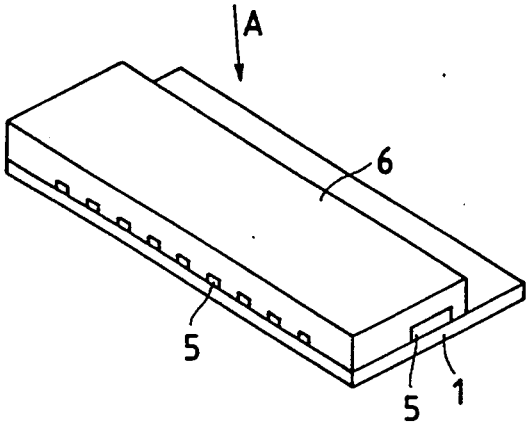
FIG. 4 is a schematic perspective view showing the state in which a second photosensitive material layer is laminated on the solid layer.

On the above solid layer 5 thus obtained is further laminated a layer 6 of a second material, particularly a second photosensitive material as shown in FIG. 4. As the resin to be used as the second photosensitive material layer 6, a nega type resist which is cured by irradiation of the above active energy ray is suitable. As the nega type resist, for example, an epoxy resin which initiates cation polymerization with light, an acrylic oligomer having acrylic ester groups which undergo radical polymerization with light, an unsaturated cycloacetal resin, a photoaddition polymerization type resin by use of a polythiol and polyene, etc. are preferred.

In the present invention, subsequently from above the second photosensitive material layer 6 as laminated above (in the direction of the arrow head A in FIG. 4), an active energy ray is irradiated. The irradiation conditions are substantially the same as described above. Thus, by irradiating the active energy ray, the second photosensitive material layer 6 is crosslinked to be insolubilized, simultaneously with formation of the acid by the above irradiation at the portion where the ink passage is to be formed (solid layer 5).

Figure 5:
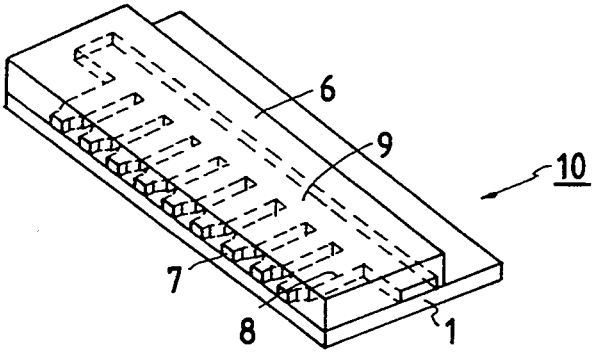
FIG. 5 is a schematic perspective view showing the ink jet recording head obtained by volatilization removal of the solid layer.

Finally, by heating the portion irradiated with the active energy ray as described above the solid layer 5 is removed by volatilization to form an ink passage as shown in FIG. 5. As described above, an ink jet recording head 10 is prepared.

Whereas, as the self developable photosensitive material, in addition to those described above, for example, there can be included nitrocellulose as described in J. Vac. Sci. Technol., B1 (4), 1178 (1983), the same B7 (6), 1178 (1989), the polysilane compound as described in SPIE. 539, 166 (1985) or the poly (o phthalaldehyde) blocked at the terminal end acetyl group or pyridine, etc. to which a compound generating acid is added as described in J. Electrochen. Sov., 133 (1), 181 (1986), Polym. Eng. Sci., 23 (18), 1012 (1983), etc. These are posi type self-developable photosensitive materials as mentioned above which become the monomers at the photoirradiated portion by decomposition and gasification of the polymer, or generation of the acid at the photoirradiated portion to effect decomposition and gasification of the polymer.

By use of the photosensitive material which can be developed and removed only by such photoirradiation, it is no longer necessary to use a solvent, whereby the problems as mentioned above can be solved. As the ink passage wall forming member provided on the solid layer, there can be included, for example, thermosetting resin materials or naturally curable resin materials which are melted, or these materials dissolved in appropriate solvents, etc. as suitable material. Among them, epoxy type, acrylic type resin materials are preferred.

Further, as the self developable photosensitive material, the poly (olefinsulfone) described in Polym. Eng. Sci., 14 (7) 525 (1974) or Polymers in Electronics, 55 (1984) may be employed. This material comprises a sensitizer such as pyridine N oxide or p nitropyridine N oxide, benzophenone, etc. added to poly(2-methylpentene-1-sulfone) or poly (1-butensulfone), etc., and it is the material which is decomposed and scattered by subsequent heating when irradiated with light. Thus, while the photosensitive materials as described above are decomposed and scattered by only photoirradiation, this material is decomposed and scattered by photoirradiation and heating.

Since such photosensitive material can also be developed and removed by photoirradiation and heating, no solvent is no longer required to be used, whereby the task of the present invention can be solved.

In using such photosensitive materials, as the ink passage wall forming material coated on the photosensitive material, for example, photocurable materials or thermosetting resin materials or naturally curable resin materials which are melted, or solutions of these resin materials dissolved in appropriate solvents can be included as the suitable material. Particularly photocurable materials are advantageous in that their curing is effected simultaneously with photoirradiation onto the solid layer.

Now, as the self-developable photosensitive material, for example, poly(4-chlorophthalaldehyde) or poly(4-bromophthalaldehyde) described in J. Electrochem. Sci., 136 (1), 241 (1989) can be included as further suitable materials. These are synthesized by anion polymerization of 4 chlorophthalaldehyde 4-bromophthalaldehyde which are gaseous at normal temperature under a low temperature of 78° C. in the presence of a catalyst.

These compounds become materials having photosensitivity by mixing a compound which generates an acid by irradiation of light. That is, an acid is generated at the photoirradiated portion, and by heating the acid, the acid decomposes the polymer to form a gasified monomer which becomes a thermally developable posi type photosensitive material. In the case of this material, the extent of the solid layer removed is further improved. Also, the photosensitive material is also relatively excellent with respect to sensitivity.

As such materials, otherwise there can be included poly(4-trimethylsilylphthalaldehyde) described in J. Electronchem. Soc., 136 (1), 245 (1989) or poly (4,5 bis(trimethylsilyl)phthalaldehyde] described in SPIE. 920, 13 (1988).

These materials are advantageous in that the photoirradiation dosage or the heating temperature during developing or removal can be set at a desired temperature by the ratio of the optical acid generating agent mixed.

As the ink passage wall forming material, for example, a photocurable material or a thermosetting resin material or naturally curable resin material which is melted, or solutions of these dissolved in appropriate solvents can be included as suitable materials. Particularly, the thermosetting material is advantageous in that its curing is effected simultaneously with photoirradiation onto the solid layer. Here, as the active energy ray curable material to be coated on the solid layer when a material requires a relatively larger dose of photoirradiation such as epoxy resin for curing thereof, that large dose of energy will be irradiated also onto the solid layer. For this reason, by making the ratio of the optical acid generating agent smaller, the function may be sometimes lowered whereby it becomes necessary to prevent self-developing in the process of curing of the coating materials of these photosensitive materials which are solid layers.

In contrast, when a material requiring not so much of a dose of photoirradiation for curing thereof such as an acrylic resin is used, the sensitivity can be enhanced by increasing the ratio of the optical acid generating agent. Also, it is useful to increase the ratio of the optical acid generating agent by the thickness of these curable materials coated.

As described above, according to the present invention, a desired material adequate in the preparation steps can be used as the active energy ray curable material to be coated on the solid layer, and also preparation of a liquid recording tape can be further easily done with a desired thickness.

As the compound generating an acid by irradiating of light, many compounds such as onium salts or polychloro compounds, etc. can be used. Among these, with respect to sensitivity, onium salts having photosensitive region in the far UV-ray region are effective. Particularly, when the photosensitive wavelength in the active ray energy curable material is in the far UV-ray region, for the purpose of inhibiting further self-developing of the solid layer during curing of the curable material, it is also possible to make the optical acid generating agent in the photosensitive material a compound having absorption wavelength in the UV-ray region such as the polyhalogen compound, etc. described in U.S. Pat. No. 3,954,475.

Whereas, for obtaining an ink passage wall forming member on the pattern-shaped solid layer, in addition to the so called casting method wherein a liquid material which becomes the ink passage wall forming member is cast onto body ink, injection molding, transfer mold molding, etc. may also be employed. Among them, the case according to transfer mold molding is further effective with respect to working efficiency, bulk productivity or dimensional precision, etc.

With a pattern-shaped solid layer comprising a self developable material being formed at the position which is to become the ink passage, an ink passage wall forming member is provided by transfer molding on the substrate so as to cover the solid layer, and then the solid layer is removed. The registration precision of the ink passage relative to the substrate is the same as the registration substrate of the solid layer relative to the substrate, and therefore it can be made with high precision.

Also, the strength of adhesion between the ink passage wall forming member and the substrate becomes sufficient, and yet the number of steps can be smaller. By constituting the surface in contact with the substrate of one mold holding the substrate of a flexible member, the force applied on the substrate during molding becomes further uniform pressure, whereby cracking of the substrate or breaking of the energy generating element on the substrate can be sufficiently prevented.

By forming an ink passage wall forming member corresponding to two ink jet recording heads under the state arranged opposed to each other integrally on the substrate, and then cutting the member, the working amount per one head is particularly reduced. By referring to the accompanying drawings, another embodiment of the present invention is described.

Figure 6:
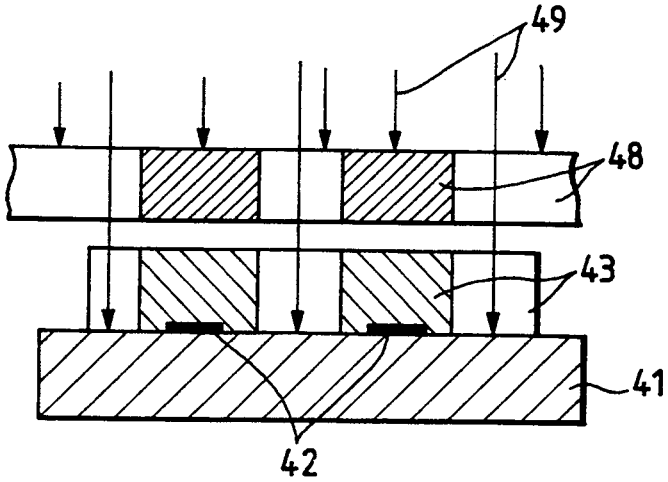
FIG. 6 is a schematic sectional view for illustration of the step of forming a solid layer by use of a mask by irradiating of UV-ray on the dry-developable photosensitive resin coated on the substrate.
Figure 7:
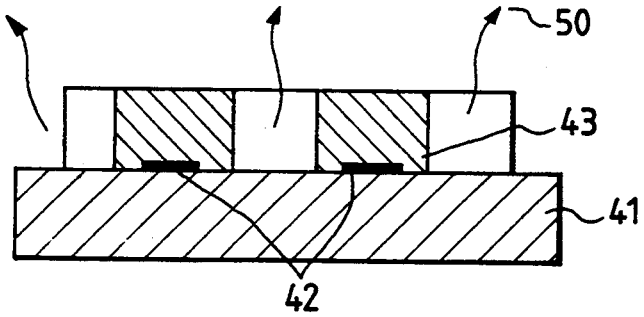
FIG. 7 is a schematic sectional view showing the state after formation of the solid layer by gasifying the portions other than the portion which is to become the flow channel according to the operation in FIG. 6.
Figure 8:
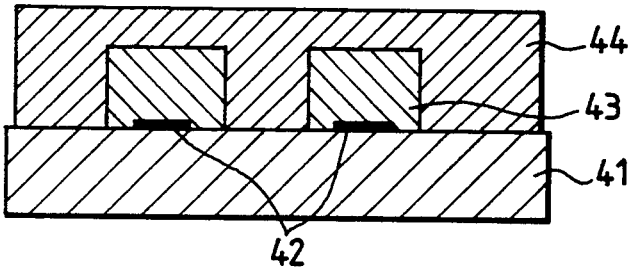
FIG. 8 is a schematic sectional view showing the state after curing of the material when a liquid curable material is used as the liquid passage wall forming material.
Figure 9:
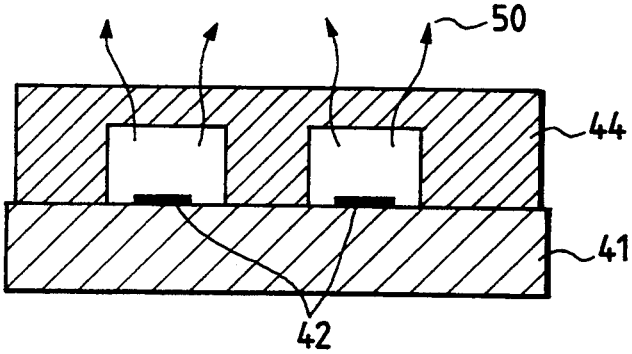
FIG. 9 is a schematic sectional view showing the state after removal of the solid layer in FIG. 8.
Figure 10:
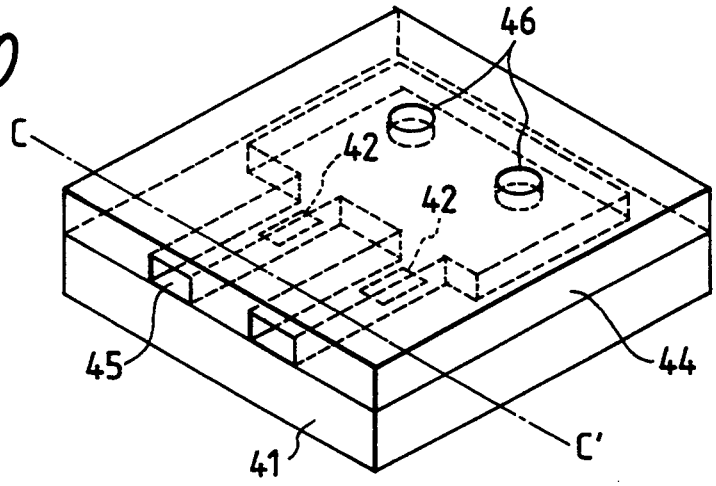
FIG. 10 is a schematic perspective view showing the completed state of one example of ink jet recording head.

FIG. 6 and FIG. 7 are schematic sectional views for illustration of the steps for forming the pattern-shaped solid layer 43 which is to become the ink passage on the substrate. FIG. 8 and FIG. 9 are respectively schematic sectional views for illustration of the step of covering the solid layer 43 with the ink passage wall forming material 44 and the step of forming the ink passage by gasification of the solid layer 43. FIG. 10 is a schematic perspective view showing the ink jet recording head prepared in such manner.

By coating a posi-type dry developable photosensitive resin (hereinafter called "DDR") for formation of a plurality of heads on the substrate 41, a layer of photosensitive resin (corresponding to 43 in the Figure) is formed. Next, as shown in FIG. 6, the layer is irradiated with UV-ray 49, and by irradiating the UV-ray 49 at the portions other than the portion which is to become the ink passage with the use of a mask 48, the portion irradiated with the UV-ray 49 is gasified (50) whereby a pattern shaped solid layer 43 is formed on the substrate 41 as shown in FIG. 7.

As the DDR to be used in the present invention:

(a) one comprising a combination of an optical acid generating agent (onium salt) and a carbonate type resin, (b) one comprising a combination of an optical acid generating agent (onium salt) and an aldehyde resin, etc. , as described in (1) Polym. J. 19 (1) 31, 1987 or (2) Polym. Eng. Sci. 23, 102, 1983 and (3) J. Electrochem. Soc., 136 (1) 241, 1989, but these are not limitative of the invention.

In this case, when DDR is photodevelopable, developing proceeds in this process, to form a solid layer. On the other hand, when DDR is heating developable, in transferring to the next process, developing proceeds when entering the heating mold (molding mold) into which the mold resin is injected.

As the next step, as shown in FIG. 8, on the substrate 41 provided with the above solid layer 43 by use of a mold resin (hereinafter called MR) as the ink channel wall forming material 44 so as to cover said solid layer 43, a transfer mold is formed. Next, the solid layer 43 of the above DDR is heated to be gasified (50). As the result, as shown in FIG. 9, an ink passage is formed on the substrate 41 with the ink passage wall forming member 44.

As the material for the above MR, crosslinkable urethane, epoxy, melamine, unsaturated resins, etc. and thermoplastic resins such as acryl, polyolefin, polyester, polysalfone, etc. can be employed.

As the working method by use of transfer mold molding of the present embodiment, a substrate having the solid layer of DDR formed thereon is inserted into the molding mold comprising the upper mold and the lower mold. As the molding conditions, when using an epoxy resin such as NT-8500 series (NITTO), EME-700 series, EME-500 series (Sumitomo Bakelite) as the molding resin, moldability is confirmed with the ranges of a molding temperature of 130° to 180° C., the curing time 1 to 5 minutes, injection pressure 30 to 100 kgf/cm$^2$ as a measure (whether foam, flash, burr, etc. is formed or not), and respective adequate points may be set. If the molding temperature is made higher, the curing time can be shorter. Also, as the injection pressure is higher, there will be no generation of foams, but excessive pressure will give rise to generation of burr, flash.

The mold substrate molded under the above molding conditions is required to be subjected to main curing before becoming the final product form. Of course, depending on the use situation of the product, the main curing step can also be omitted.

In the present embodiment since DDR is employed as the solid layer, removal of the solid layer is finally required and heating is effected as the removal means, by carrying out the post-cure as both removal of the solid layer and curing of the mold resin, the number of steps is further reduced to give the optimum characteristics of the main mold resin. As the conditions of the post-cure, a temperature of 180° to 250 ° C. and a time of 30 minutes to 2 hours are general, but by increasing the temperature, the treatment within shorter time is possible, and irradiation of UV-ray is more effective before heating as the removal accelerating means of the solid layer. However, the mold resin to be used in this case is required to be transparent or translucent.

When cutting formation of discharging outlets is required to be performed, it may be carried out either after transfer molding or after post-cure. As the curring method, a known method such as dicing of wafer may be employed. When carried out after transfer molding, since the solid layer is filled in the ink passage during cutting of ink discharging outlets, progress toward the inner portion of discharging outlets which are one of the factors for causing clogging of discharging outlets of the ink jet recording head such as cut powder, dust, etc. can be prevented.

To describe in more detail about an example of the step of using a photosensitive resin of the self developing type first a posi type self developing type resist is coated according to a known method on a substrate. The photodevelopable resist which is the self-developable resist has its photoirradiated portion which is gasified scattered as such, and the acid generated by photoirradiation disperses the compound. As such substance, one having an onium salt as the optical acid generating agent added to a polyphthalaldehyde alkylated or acylated at the terminal end may be preferably used from such points as sensitivity acid resistance, etc. (see H. Ito et al. Polym. Eng. Sci., 23, 1012, 1983, etc.)

The photoirradiated portion of the self-developing resist is stable up to about 200 ° C., and decomposition, gasification will abruptly proceed at temperatures higher than that. In the case of coating, cellosolve acetate which is a resist solvent in general can be used. When an excimer laser is used particularly as the light source no optical acid generating agent is required.

First a resist comprising a polyphthalaldehyde alkylated at the terminal end+triphenylsulfonium hexafluoroantimonate +cellosolve acetate is coated on the substrate, baked to form a film.

Next, by irradiating far UV-ray by an Hg lamp, the layer is subjected to patterning. Next, the substrate is inserted into the molding mold, the molding resin is injected and heated, thereby effecting preliminary curing. The resist exists stably at a temperature of 200° C. or lower.

Next, the resist is removed, and when the molding resin transmits light (in this case far IR-ray), the resist can be removed by effecting photoirradiation as such. Further, by using heating in combination, removal speed is accelerated. Also even when no light is transmitted, removal may be possible by heating to 200° C. or higher, and in this case it is more convenient, because the post cure of the molding resin is effected at the same time.

Among the resists of the self developing type, the posi-type thermally developable resist will be gasified and scattered at only the photoirradiated portion by heating. As such resist, one having an onium salt added as the optical acid generating agent to a polycarbonate (Polym. J. 19 (1) 31, 1987, etc.), one having an onium salt added to poly (4-chlorophthalaldehyde) , poly (4-bromophthalaldehyde) , poly (4-trimethylsilylphthalaldehyde) (J. Electrochem, Soc 136 (1) 241, 1989 etc.) may be included but the latter may be preferably used in aspect of sensitivity, etc.

The thermally developable resist is stable at the photo-unirradiated portion up to about 220 ° C., and decomposition and gasification will proceed rapidly on the portions other than that. At this time, no flow of heat will occur at all and heat resistance is very excellent.

The optical acid generating agent is not limited to onion salts, but those of polychloro compounds or nitrobenzyl sulfonate, etc. may also be used.

First, a resist comprising a poly(4-chlorophthalaldehyde)+triphenylsulfoniumhexafluoroantimonate +cyclohexane is coated on the substrate, and baked to form a film.

Next, after irradiation of far UV-ray, by heating at 160 pC for 3 to 5 minutes (preferably in vacuum), developing is completed. If the photoirradiation dosage is more at this time, the heating time can be shortened correspondingly. Next, by inserting the substrate having the solid layer formed thereon into the molding mold, and a molding resin is injected. At this time, if the molding mold is preliminarily heated at 160° C., the main curing of the molding resin can also be effected simultaneously with preliminary curing. At this time, if the temperature is 220° C. or lower, the resist exists stably. Removal of the resist is carried out by photoirradiation from the above when the molding resin transmits the far UV-ray, and is accomplished by heating at 160° C. in vacuum. Also, even when the molding resin transmits no far UV-ray, by heating in vacuum to 220° C. or higher, the resist can be removed. At this time, since the post cure of the molding resin can be effected at the same time, which will lead to simplification of the steps.

Figure 12:
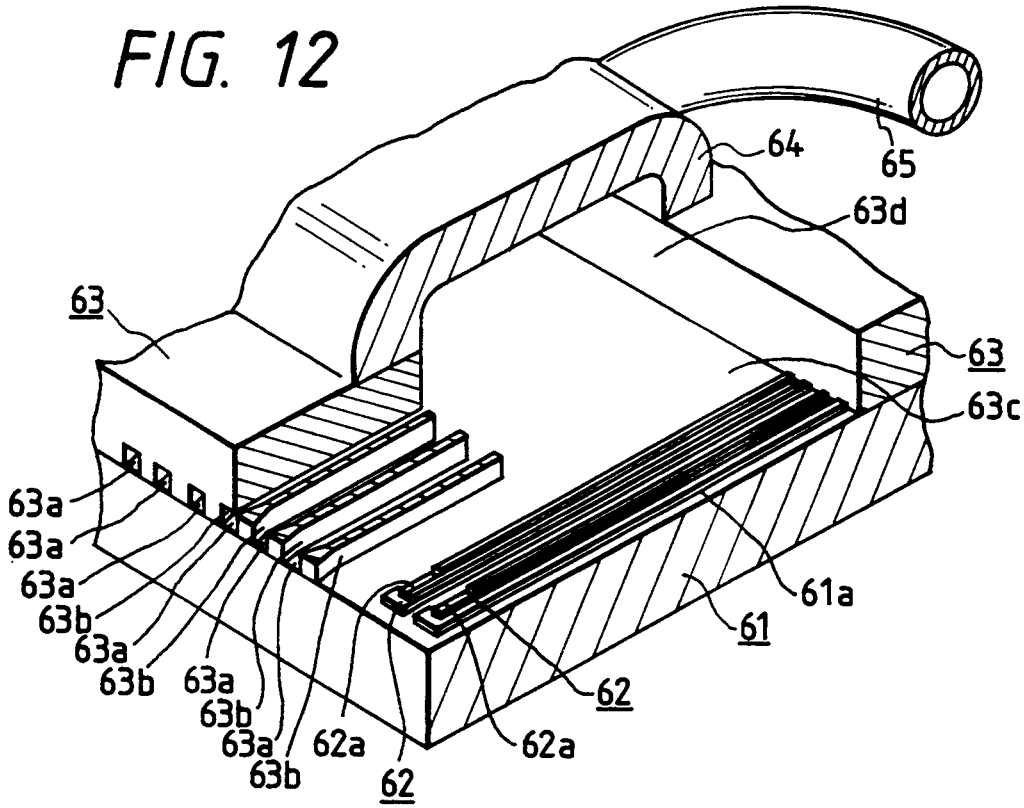
FIG. 12 is a partially broken schematic view of one example of the ink jet recording head.

Next, still another embodiment of the present invention is described. First by referring to the drawings, the ink jet recording head prepared is described. In FIG. 12, on the element surface 61*a* of the substrate 61 comprising a glass or a wafer of silicone, the heat generating portions 62*a* and the electrodes 62 constituting electrothermal transducers are formed by utilizing the semiconductor preparation process such as etching, vapor deposition, sputtering, etc. to be juxtaposed at predetermined intervals. Also, the element surface 61*a* has an ink passage wall forming member 63 comprising for example, thermosetting resins such as epoxy resin, silicone resin etc. formed by transfer molding.

In the ink passage wall forming member 63, a plurality of grooves are formed corresponding to the respective positions of the heat generating portions 62*a* of electro-thermal transducers, and the space surrounded by the groove and the element surface 61*a* constitutes respectively the ink channel 63, the opening opened toward to the outside of the ink channel 63*b* constituting the respective discharging outlets 63*a*. At the discharging outlet surface 66 where each discharging outlet 63*a* is opened, in order for no ink to reside, a water repellent agent (not shown) which repels ink is attached by coating or transfer to be applied with the water repellent treatment. Also, at the ink passage wall forming member 63, a cavity portion communicated to the ink channel 62*b* formed by each groove and having the element surface 61*a* as the bottom wall is formed, and the cavity portion constitutes the liquid chamber c. Further, the opening communicating the liquid chamber 63 to the external portion (connector 64, etc. as described below) is formed as opened in the same direction as the direction in which the element surface 61*a* is formed, and the opening is the feeding inlet 63*d*.

The feeding inlet 63*d* has the feeding pipe 65 connected to an ink tank, etc. (not shown ) connected through a connector 64 , and has the constitution that ink is fed by passing through the feeding inlet 63*d* from the ink tank to the liquid chamber 63*c*.

Here, the actuation when ink is discharged from each discharging outlet 63*a* is discharged is described. The ink tentatively stored fed in the liquid chamber 63 will penetrate by capillary phenomenon into the ink channel 63*b*, forms a meniscus at the discharging outlet 63*a* to maintain the state filling the ink channel 63*b*. At this time, when the heat generating portion 62a of the electrothermal transducer generates heat by current passage through the electrode 62, the ink on the heat generating portion 62a is abruptly heated, whereby bubbles are generated within the ink channel 63b and the ink is discharged from the discharging outlet 63a by expansion of the bubbles.

As the energy generating element for generating the energy to be utilized for discharging ink, electrotransducers are shown, but this is not limitative. A piezoelectric element which generates mechanical energy applying discharging pressure momentarily on the ink etc. may also be used. Also, the discharging outlet 63a can be formed in number of, for example, 128 or 256 with a high density of 16 /mm, and further a full-line type can also be made by forming a number over the full width of the recording region of the recording medium.

Figure 13:
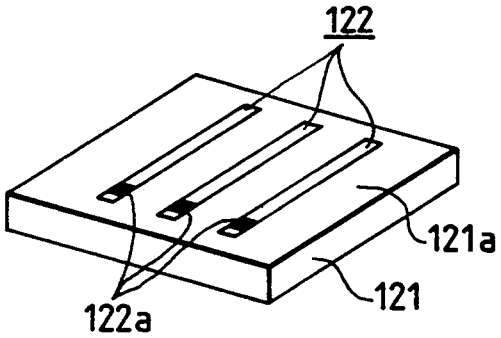
FIG. 13 is a schematic perspective view showing an example of the substrate employed.

Next, the preparation process of the ink jet recording head according to the present embodiment is described. As shown in FIG. 13 , the element surface 121a of the substrate 121 comprising a glass or a wafer of silicone has an electro-thermal transducer including the heat generating portion 122a and the electrode 122 formed by film formation utilizing the semiconductor preparation process such as etching, vapor deposition, sputtering at predetermined intervals.

In the present embodiment, a description is proceeded about one provided with three energy generating elements, the numbers of energy generating elements and the ink channels and discharging outlets corresponding thereto are not limited to three, but otherwise the number may be suitably changed. Also, although not shown, for the purpose of improving durability, etc., it is general practice to provide various functional layers such as protective films, etc. on the electrothermal transducer.

Figure 14:
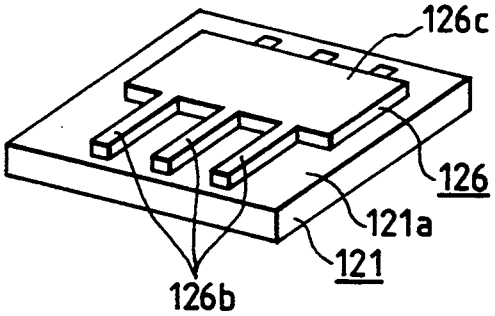
FIG. 14 is a schematic perspective view showing the substrate having a solid layer formed thereon.

FIG. 14 shows the state having the solid layer 126 shaped in a pattern comprising a dry developable resist at the portion which is to become the ink channels and the liquid chamber of the element surface 121 of the substrate 121 by utilizing the photoforming process. Of the solid layers 126, the respective ink channel portions 126b are the portions which play a role of the mold for forming the wall of the ink channel, and of the solid layers 126, the liquid chamber portion 126c is the portion which plays a role of the mold for forming the wall of the liquid chamber. The respective ink channel portions 126b of the solid layer 126 cover the respective electro-thermal transducers. The dry developable resist will be described later.

Next, the step of providing a resin which becomes the ink passage wall forming member on the element surface 121a having formed the solid layer 126 on the substrate 121 is described. In the present embodiment, an example according to transfer molding is shown, but the method of providing the resin is not limited to transfer molding at all.

Figure 15:
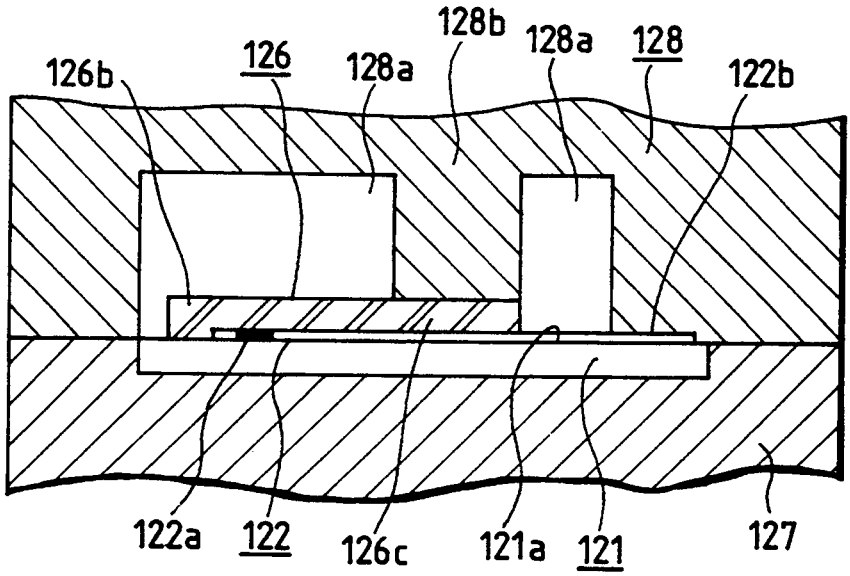
FIG. 15 is a schematic sectional view showing the mold to be employed.

First, the mold to be used in transfer molding is described. As shown in FIG. 15, the mold comprises a first mold 127 and a second mold 128. In the first mold 127, a concavity with equal depth to the thickness of the substrate 121 for fitting and fixing the substrate 121 is formed, and is constituted so that the element surface 121a of the substrate 121 may be on the same plane as the parting surface when the substrate 121 is fitted into the concavity. In the second mold 128, a cavity portion 128a for molding the resin which becomes the ink passage wall forming member constituting the ink channel and the liquid chamber is formed. Inside of the cavity portion 128a, a projected portion 128 is formed for forming the liquid chamber and the feeding inlet for feeding ink from outside into the liquid chamber. The tip end surface of the projected portion 128b comes into contact with the upper surface shown of the liquid chamber portion of the solid layer 126 during mold clamping. Of the element surfaces 121a of the substrate 121, a part including the electrical connecting portion 122b is constituted so that it may be bulged out toward the parting surface side of the second mold 128 from the cavity portion 128a during mold clamping.

Figure 16:
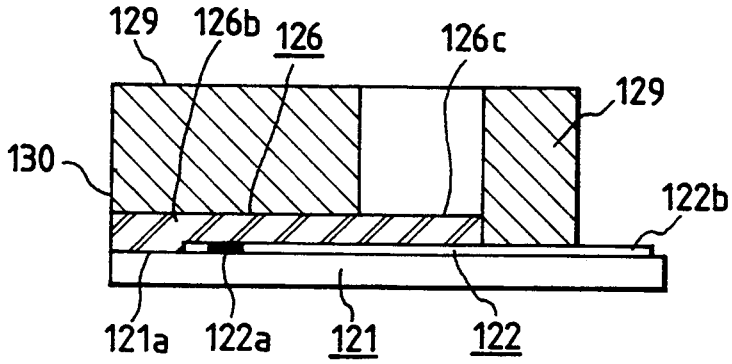
FIG. 16 is a schematic sectional view showing the state in which a resin is molded by use of a mold on the substrate.

The ink passage wall forming member 129 formed of the first mold 127 and the second mold 128 as described above covers the respective ink channel portions 126b of the solid layer 126 as shown in FIG. 16, and have a part of the liquid chamber portion 126c of the solid layer 126 exposed. Also, after mold release, the substrate 121 and the ink passage wall forming member 129 are cut at predetermined sites to form the discharging outlet surface 130, and the discharging outlet surface 130 has the surface corresponding to the discharging outlet of the solid layer 126 exposed.

Although partially described above, transfer molding can be performed by using, for example, a thermosetting epoxy resin as the material for the ink passage wall forming member 129 under the general molding conditions of a resin preheating temperature 60 to 90° C., an injection pressure 20 to 140 kgf/cm$^2$, a molding mold temperature 100 to 180° C. a curing time 1 to 10 minutes and post-cure after molding. As other materials of the ink passage wall forming member 129, liquid materials having normal temperature curability, thermal curability or UV-ray curability can be used, as exemplified by epoxy resins, acrylic resins, diglycol dialkylcarbonate resins, unsaturated polyester resins, polyurethane resins, polyimide resins, reelamine resins, phenol resins, urea resins, etc.

Figure 11A:
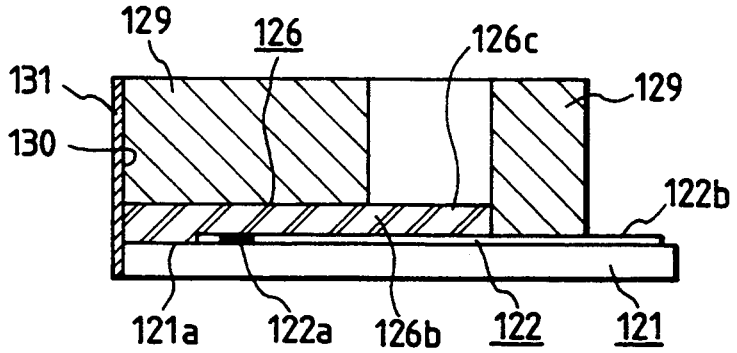
FIG. 11A is a schematic sectional view showing the state in which a water repellent agent is attached on the surface of the discharging outlet.

FIG. 11A shows the state with the water repellent agent 131, including the circumference of the surface corresponding to the discharging outlet of the solid layer 126 of the surface of the substrate 121 and the ink passage wall forming member 129, namely including the surface corresponding to the discharging outlet of the solid layer 126 in addition to the discharging outlet surface 130.

As the method for attaching the water repellent agent 131 to the discharging outlet surface 130, a means known in the art can be used. For example, there is the method in which a coating roller, a plate-shaped, film-shaped support is coated with the water repellent agent 131 and the support is pushed against the discharging outlet surface 130 to have the water repellent agent 131 transferred onto the discharging outlet surface 130. Also, there may be employed a means in which the water repellent agent 131 is sprayed to be attached onto the discharging outlet surface 130, or a means in which only the portion of the discharging outlet surface 130 is dipped in the water repellent agent 131. As the film thickness of the water repellent agent 131, 1 μm or less is desirable.

Figure 11B:
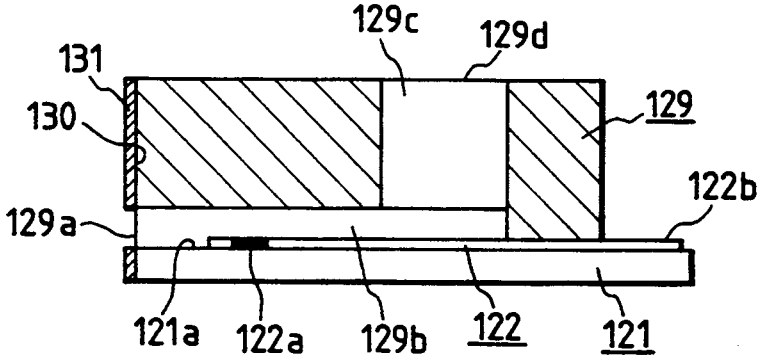
FIG. 11B is a schematic sectional view showing the state in which the solid layer is removed.

FIG. 11B shows the state with the solid layer 126 being removed from the substrate 121 having the water repellent agent 131 attached on the discharging outlet surface 130 and the ink passage wall forming member 129 with at least one of light and heat. Internally of the ink passage wall forming member 129 is formed a space by removal of the solid layer 126, and the space constitutes the ink channel 129b, the liquid chamber 129c and the feeding inlet 129d, while the opened end of the ink channel 129 becoming the discharging outlet 129a. Also, the discharging outlet surface 130 is attached with the water repellent agent 131 as such, and the water repellent agent 131 attached on the surface corresponding to the discharging outlet of the solid layer 126 is removed together with the solid layer 126.

The present invention is described in more detail below by referring to Examples. Unless otherwise noted, the ratios are based on weight.

EXAMPLE 1

According to the preparation steps shown in FIG. 1 to FIG. 5, a liquid jet recording head was prepared.

First, on a glass substrate having an electrothermal transducer 2 (material of heat-generating resistance layer: $HfB_2$) formed as the energy generating element thereon a solution comprising:

a polycarbonate having the structure of (a) shown in Table 1 1.35 parts by weight triphenylsulfonium hexafluoroarsenate 0.13 part by weight methyl cellosolve acetate 10 parts by weight was coated by an applicator, and dried at 80° C. for minutes to form a first photosensitive material layer 3 comprising a thin film of about 15 μm (FIG. 1). Onto the photosensitive material layer 3 was superposed a mask having a pattern corresponding to the ink channel shown by the dotted line in FIG. 2, a far UV-ray which is an active energy ray was irradiated at the portion excluding the sites where the ink channel including the ink flow channel and the common liquid chamber is to be formed.

Next, the substrate provided with the first photosensitive material layer having formed a latent image was heated to 80° C., to effect a pattern developing by removing the portion irradiated with the far UV-ray by volatilization, thereby forming a solid layer 5 as shown in FIG. 3 at the site where the ink channel is to be formed on the glass substrate.

On the substrate having the solid layer 5 formed thereon, by use of a mixture of epoxy resins produced by Nippon Union Carbide K.K.:

Cyvacure UVR-6110; 40 parts;

Cyvacure UVR-6200; 20 parts;

Cyvacure UVR-6351; 40 parts;

and 2.5 parts of triphenylsulfonium hexafluoroantimonate as the catalyst as the active energy-ray curable material, it was coated by an applicator with a thickness of about 70 microns to form a second photosensitive material layer 6 (FIG. 4). By irradiating a UV-ray which is an active energy ray by a ultra-high pressure mercury lamp from the direction of the upper surface of the substrate 1, the active energy ray curable material was cured. At this time, the solid layer 5 is also irradiated with the UV-ray through the second photosensitive material layer 6.

Next, by heating the material thus formed at 80° C. in vacuum, the solid layer 5 was removed to form the liquid flow channel 8 communicated to the ink discharging outlet and the con, non liquid chamber 9. At this time, by heating in vacuum, curing of the second photosensitive-material layer 6 further progressed.

In the ink flow channel of the liquid jet recording head 10 and the con, non liquid chamber 9 shown in FIG. 5 thus prepared, no residue of the solid layer existed. Also, since no solution was used for developing, no swelling of the second photosensitive material layer 6 was seen, and no fine peeloff from the substrate was recognized at all.

EXAMPLE 2

A liquid jet recording head was prepared in substantially the same manner as in Example 1. However, as the material of the first photosensitive material layer, a solution comprising:

a polycarbonate having the structure of (b) shown in Table 1 1.40 parts by weight triphenylsulfonium hexafluoroarsenate 0.13 part by weight methyl cellosolve acetate 10 parts by weight was used, and dried at 80° C. for 10 minutes to form a first photosensitive material layer 3. Developing was carried out by heating at 70° C. and removal of the solid layer 5 for forming ink channel was carried out by heating in vacuum at 70° C.

In the liquid channel and the common liquid chamber etc. of the liquid jet recording head thus prepared, no residue of the solid layer 5 existed. Also, no swelling of the second photosensitive material layer (active energy ray curable material) was seen, and no fine peel-off from the substrate was also confirmed at all.

EXAMPLE 3

A liquid jet recording head was prepared in substantially the same manner as in Example 1. First, on a glass substrate adhered with a piezoelectric body $PbTiO_3$ (not shown) as the energy generating element from the back side was coated by an applicator. A solution comprising:

a polycarbonate having the structure of (c) shown in Table 1 1.40 parts by weight triphenylsulfonium hexafluoroarsenate 0.13 part by weight ethyl cellosolve acetate 10 parts by weight, was used and dried at 80° C. for 10 minutes to form a first photosensitive material layer which is a thin film of about 15 pm. Onto the first photosensitive material layer was superposed a mask having a pattern corresponding to the ink channel shown by the dotted line in FIG. 2, and a far UV-ray was irradiated at the portion excluding the sites where the ink channel is to be formed.

Next, the substrate was heated to 80° C., and by removing the portion where the UV-ray was irradiated by volatilization, pattern developing was effected to form a solid layer 5 as shown in FIG. 3 at the site where the ink channel is to be formed on the glass substrate. On the substrate having the solid layer 5 formed thereon, a mixture of acrylic resins produced by Sunpco K.K.:

Photomer 4149: 50 parts;

Photomer 3016: 50 parts;

and 3.0 parts by weight of benzyldimethylketal as the catalyst was used as the active energy ray curable material, and coated by an applicator with a thickness of 70 microns to form a second photosensitive material layer 6 (FIG. 4). By irradiation of a UV-ray from the direction of the upper surface of the substrate, the active energy ray curable material was cured. At this time, the solid layer 5 was also irradiated with the UV-ray through the active energy ray curable material. Next, by heating of the material thus formed under vacuum at 80° C., the solid layer 5 was removed by volatilization to form the ink flow channel 8 and the common liquid chamber 9 (FIG. 5). At this time, by heating in vacuum, curing of the active energy ray curable material further progressed. In the ink flow channel and the common liquid chamber of the liquid jet recording head thus formed, no residue of the solid layer existed.

Also, no swelling of the active energy ray curable material was seen, and no fine peel-off from the substrate accurred.

EXAMPLE 4

A liquid jet recording head was prepared in substantially the same manner as in Example 3. However, as the material of the first photosensitive material layer a solution comprising:

a polycarbonate having the structure of (d) shown in Table 1 1.40 parts by weight triphenyliodonium hexafluorophosphate 0.15 part by weight ethyl cellosolve acetate 10 parts by weight was used, and dried at 80° C. for 10 minutes to form a thin film of the first photosensitive material layer. Developing was carried out by heating at 70° C., and removal of the solid layer for forming the liquid flow channel, etc. was performed by heating in vacuum at 70° C. In the ink flow channel and the con, non liquid chamber of the liquid jet recording head thus prepared, there existed no residue of the solid layer existed. Also, no swelling of the active energy ray curable material was seen, and no fine peel-off from the substrate accurred.

EXAMPLE 5

As shown in FIG. 1, a solution comprising the following composition was coated on a substrate 1 according to the spin coating method.

Poly(O-phthalaldehyde) acetylated at terminal end 5 parts by weight

Triphenylsulfonium hexafluoroarsenate 0.5 part by weight

Cyclohexanone 20 parts by weight.

The substrate was dried at 80° C. for 10 minutes, to form a photosensitive material layer 3 of about 10 μm.

Further, a mask having a pattern of the shape shown by the symbol 4 in FIG. 2 was superposed on the photosensitive material layer 3, and a far UV-ray of about 50 mJ·cm$^2$ was irradiated under vacuum at the portion excluding the sites where the ink channel and the common liquid chamber are to be formed. By such irradiation, the photosensitive material layer 3 at the site where the far UV-ray irradiated was decomposed to be gasified, whereby the solid layer 5 corresponding to the sites where the ink channel and the common liquid chamber are to be formed on the glass substrate as shown in FIG. 3 remained.

Next, as shown in FIG. 4, on-the substrate 1 having the solid layer 5 formed thereon, a defoamed Araldite CY230/HY956 (trade name, produced by Ciba Geigy) which is a thermosetting epoxy resin was coated by an applicator with a thickness of about 30 μm. Then, these were heated at 100° C. for 30 minutes, thereby curing the thermosetting resin to form an ink channel wall forming member 6.

Next, from the site of the discharging outlet 7, and subsequently from the site of the ink feeding outlet (both sides of the common chamber 9), respectively, a far UV-ray of about 1 J·cm$^{-2}$ was irradiated in vacuum, and further from the upper surface side of the substrate, a far UV-ray of about 5 J·cm$^{-2}$ was irradiated in vacuum. By these irradiations, the solid layer 5 was dissolved away. The cavity at the portion removed was made the ink channel 8 and the con, non liquid chamber 9 (FIG. 5). The removal speed may be also accelerated by performing heating at the same time during the irradiation.

In the ink jet recording head thus prepared, no swelling was seen because the ink channel wall forming material was not exposed to the solvent, and also no fine peel-off from the substrate accured.

EXAMPLE 6

In this Example, an ink jet recording head was prepared in substantially the same manner as in Example 5.

However, as the material for forming the photosensitive material layer 3, a solution comprising, Nitrocellulose: 3.5 parts by weight;

Amylacetate: 50 parts by weight;

was used, and heating drying was applied under a nitrogen atmosphere at 80° C. for 30 minutes to form a photosensitive material layer 3 (FIG. 1).

Next, by irradiating an ArF laser of about 3 keV through a mask in vacuum, a solid layer was formed (FIG. 3).

Subsequently, a thermosetting material was coated and cured on the solid layer formed on the substrate in the same manner as in Example 5 (FIG. 4). Further, an ArF laser irradiation of about 10 keV was effected in vacuum from the upper surface side of the substrate to remove the solid layer 5, thereby forming the ink channel 8 and the common liquid chamber 9 (FIG. 5). During the irradiation, heating may be performed at the same time to accelerate the removal speed.

Also by this Example, a good ink jet recording head could be prepared.

EXAMPLE 7

In this Example, an ink jet recording head was prepared in substantially the same manner as in Example 5. First, on the glass substrate having a piezoelectric body $PbTiO_2$ (not shown) adhered as the energy generating element from the back side was coated with a solution comprising the following composition according to the spin coating method.

Copolymer of isopropylmethylsilane and n-propylmethylsilane: 5 parts by weight

THF: 10 parts by weight

O-xylene: 10 parts by weight.

By drying the substrate 1 coated with the solution under an atmosphere of 80° C. for 10 minutes, a photosensitive material layer 5 of about 7 μm was formed (FIG. 1). By superposing a mask having a pattern indicated by the symbol 4 in FIG. 2 on the photosensitive material layer, a far UV-ray of about 3 J·cm$^2$ was irradiated in vacuum at the portion excluding the sites where the ink channel and the common liquid chamber are to be formed. By such irradiation, the photosensitire material layer at the far UV-ray irradiated portion was decomposed to be gasified, whereby the solid layer 5 corresponding to the portion where the ink channel and the common liquid chamber are to be formed on the glass substrate 1 remained (FIG. 3).

On the substrate 1 having the solid layer 5 formed thereon defoamed Acrysilap SY-105 (trade name, produced by Mitsubishi Rayon) which is a thermosetting acrylic resin was coated by an applicator with a thickness of about 20 μm.

Then, the substrate was heated at 70° C. for 1 hour, thereby curing the liquid thermosetting resin on the substrate 1 to form an ink channel wall forming member 6 (FIG. 4).

Next, from the discharging outlet 7 side, subsequently from the side of the ink feeding outlet (both sides of the common liquid chamber 9) were respectively irradiated a UV-ray of about 5 $J \cdot cm^{-2}$ in vacuum, and further a far UV-ray of about 40 $J \cdot cm^{-2}$ was irradiated from the upper surface of the substrate in vacuum. By these irradiations, the solid layer 5 was removed. The removed portion was made the ink channel 8 and the con, non liquid chamber 9 (FIG. 5).

Also, by this Example, a good ink jet recording head could be prepared.

EXAMPLE 8

As shown in FIG. 1, on a glass substrate was coated a solution comprising:

Poly(1-butenesulfone): 5 parts by weight;

p Nitropyridine-N oxide: 1 part by weight;

Nitromethane; 20 parts by weight;

according to the spin coating method, and dried at 100° C. for 15 minutes to prepare a photosensitive material layer 3 of about 10 μm (FIG. 1).

On the photosensitive material layer 3 was superposed a mask having a pattern indicated by the symbol 4 in FIG. 2, and a far UV-ray irradiation was effected at the portion excluding the sites where the ink channel and the common liquid chamber are to be formed.

Next, by heating the substrate having the photosensitive material layer formed thereon to 100° C., the material at the portion where the far UV-ray was irradiated was decomposed to be scattered away. By this, the pattern developing was effected to form a solid layer 5 corresponding to the portion where the ink channel and the common liquid chamber are to be formed on the glass substrate 1 (FIG. 3).

On the substrate 1 having the solid layer formed thereon was coated a mixture of a small amount of triphenylsulfonium hexafluoroantimonate as the catalyst mixed into Epoxy resins produced by Nippon Union Carbide K.K.

Cyvacure UVR 6110: 40 parts;

Cyvacure UVR 6200: 20 parts;

Cyvacure UVR 6351: 40 parts;

as the active energy ray curable material by an applicator with a thickness of about 40 microns. By irradiating this with a UV-ray by a ultra-high pressure mercury lamp from the upper surface side of the substrate 1, the active energy ray curable material was cured to form an ink channel wall forming member 6 (FIG. 4 ) . At this time, the UV-ray was also irradiated on the solid layer 5 through the active energy ray curable material.

Next, by heating the material thus prepared in vacuum to 100° C., the solid layer 5 was decomposed away to form the ink channel 8 and the common liquid chamber 9 (FIG. 5). At this time, by heating in vacuum curing of the active energy ray curable material further progressed.

In the ink channel and the common liquid chamber of the ink jet recording head thus prepared no residue of the solid layer 5 existed.

EXAMPLE 9

In this Example, an ink jet recording head was prepared in substantially the same manner as in Example 8.

However, as the material forming the photosensitive material layer 3, a solution comprising:

Poly(2-methylpentene-1sulfone): 4.5 parts by weight-)

Poiydine-N oxide: 1 part by weight

Nitromethane: 20 parts by weight; was used.

Developing removal of the solid layer, etc. were performed in the same manner as in Example 8.

Also by this Example, a good ink jet recording head could be prepared.

EXAMPLE 10

On a glass substrate adhered on the back side with a piezoelectric body $PbTiO_2$ (not shown) as the energy generating element, was coated with a solution comprising:

Poly(1-butenesulfone): 5 parts by weight;

Benzophenone: 1.2 parts by weight;

Nitromethane: 20 parts by weight according to the spin coating method, and dried at 100° C. for 15 minutes to form a photosensitive material layer 3 of about 10 μm.

On the photosensitive material layer 3 was superposed a mask having a pattern indicated by the symbol 4 in FIG. 2, and a far UV-ray was irradiated at the portion excluding the sites where the ink channel and the common liquid chamber are to be formed. Next, the substrate 1 having the photosensitive material layer formed thereon was heated to 100° C., thereby removing the portion irradiated with a far UV-ray. By this, pattern developing was effected to form the solid layer 5 as shown in FIG. 3 at the portion where the ink channel and the common liquid chamber are formed on the glass substrate 1 (FIG. 3).

On the substrate having the solid layer 5 formed thereon, the defoamed active energy ray curable material comprising the composition shown below was coated by use of an applicator to a thickness of about 40 μm.

KRM2410 produced by Asahi Denka Kogyo: 70 parts by weight;

Eporite 3002 produced by Kyoeisha Yushi Kagaku Kogyo: 30 parts by weight;

A 187 produced by Nippon Unicar: 5 parts by weight;

SP-170 produced by Asahi Denka Kogyo: 1.5 parts by weight.

By irradiating a UV-ray from the upper surface side of the substrate coated with this material, the active energy ray curable material was cured (FIG. 4). At this time, the UV-ray was irradiated also on the solid layer 5 through the active energy ray curable material.

Next, by heating the material thus prepared in vacuu, to 100° C., the solid layer 2 was removed. The cavity formed by such removal was made the ink channel 8 and the common liquid chamber 9 (FIG. 5).

Also by this Example, a good ink jet recording head could be prepared.

EXAMPLE 11

On a glass substrate 1, a solution comprising: 4 Chlorophthalaldehyde having the following formula (wherein $R_1$ is Cl and $R_2$ is H)

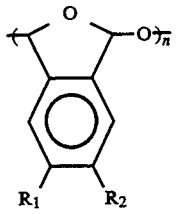

100 parts by weight

Triphenylsulfonium hexafluoroantimonate: 0.02 part by weight;

Cyclohexanone: 50 parts by weight;

was coated according to the spin coating method, and dried at 100° C. for 10 minutes to obtain a photosensitive material layer 3 of about 7 μm (FIG. 1).

On the photosensitive material layer 3 was superposed a mask having a pattern indicated by the symbol 4 in FIG. 2, and a far UV-ray of about mJ·cm$^{-2}$ was irradiated at the portion excluding the sites where the ink channel and the common liquid chamber are to be formed.

Next, pattern developing was performed by heating the substrate having the photosensitive material layer formed thereon to 130° C. to remove the portion irradiated with the far UV-ray, thereby forming the solid layer 5 corresponding to the portion where the ink channel and the common liquid chamber are to be formed on the glass substrate 1 (FIG. 3).

On the substrate 1 having the solid layer 5 formed thereon, an active energy ray curable material obtained by mixing the composition shown below which was defoamed by a vacuum pump was coated by an applicator to a thickness of about 30 μm.

KRM42410 produced by Asahi Denka Kogyo: 70 parts by weight;

Eporite 3002 produced by Kyoeisha Yushi Kagaku Kogyo: 30 parts by weight;

A-187 produced by Nippon Unicar: 5 parts by weight;

SP-170 produced by Asahi Denka Kogyo: 1.5 parts by weight.

Then, by irradiating a UV-ray of about 8 J·cm$^{-2}$ from the upper portion of the active energy ray curable material, the active energy ray curable material was cured to form an ink channel wall forming member 6 (FIG. 4). At this time the solid layer 5 was also irradiated with the UV-ray through the active energy ray curable material, and the solid layer 5 could remain sufficient as the solid without self-development by good control of its sensitivity.

Next, by heating the material thus prepared in vacuum to 130° C., the solid layer 5 was decomposed away to form the ink channel 8 and the common liquid chamber 9 (FIG. 5). At this time, by heating in vacuum, curing of the active energy ray curable material could be further progressed.

Also by this Example, a good ink jet recording head could be prepared.

EXAMPLE 12

In this Example, an ink jet recording head was prepared in substantially the same manner as in Example 11.

However, as the material forming the photosensitive material layer, a solution comprising: Poly(4-bromophthaldehyde) (in the following structural formula $R_1$ is Br and $R_2$ is H)

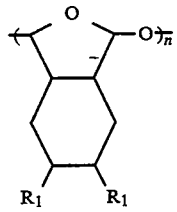

10 parts by weight

Triphenylsulfonium hexafluoroantimonate: 0.2 part by weight;

Cyclohexanone: 50 parts by weight;

was used, and the far UV-ray dosage was made about 5 mJ·cm$^{-2}$. As the active energy ray curable material, a mixture of acrylic resins produced by Sunpco K.K.:

Photomer 4149: 50 parts;

Photomer 3016: 50 parts;

and a small amount of benzyldimethylketal as the catalyst was used, and coated on the solid layer 5 subjected to patterning with a thickness of about 30 μm.

Also, for curing of the material, a UV-ray irradiation of about 2 J·cm$^{-2}$ was applied, and the solid layer 5 could sufficiently remain as the solid without self development. Developing was conducted by heating at 100° C., and removal of the solid layer for formation of the ink channel 8 and the common liquid chamber 9 by heating at 100° C. in vacuum, respectively.

Also by this Example a good ink jet recording head could be prepared.

EXAMPLE 13

On a glass substrate 1 adhered on the back side with a piezoelectric body $PbTiO_3$ (not shown) as the energy generating element, a coating solution comprising: Poly(4-trimethylsilylphthalaldehyde) (in the following structural formula $R_1$ is $Si(CH_3)_3$ and $R_2$ is H)

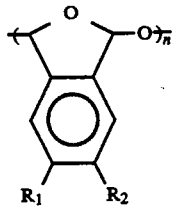

10 parts by weight

Triphenylsulfonium trifurate: 0.5 part by weight;

Cyclohexanone: 50 parts by weight;

was coated according to the spin coating method, and dried at 100° C. for 10 minutes to form a photosensitive material layer 3 of about 7 μm (FIG. 1).

On the photosensitive material layer 3 was superposed a mask having a pattern indicated by the symbol 4 in FIG. 2, and a far UV-ray of about 3 mJ·cm$^{=2}$ was irradiated at the portion excluding the sites where the ink channel and the con, non liquid chamber are to be formed.

Next, by heating the substrate having the photosensitive material layer formed thereon to 110° C., thereby removing the portion irradiated with the far UV-ray to effect pattern developing, and form the solid layer 5 corresponding to the portion where the ink channel and the common liquid chamber are to be formed on the glass substrate 1.

On the substrate 1 having the solid layer 5 formed thereon, a mixture of a thermosetting epoxy resin Araldite CY230/HY956 (trade name, produced by Ciba Geigy) with a catalyst was defoamed and coated by use of an applicator to a thickness of about 30 μm. Then, the substrate was heated at 100° C. for 30 minutes to cure the liquid curable material on the substrate (FIG. 4).

Subsequently, from the upper side of the substrate was irradiated a far UV-ray of about 1 $J \cdot cm^{-2}$. Further, by heating the substrate to 110° C. in vacuum, the solid layer 5 was removed to form the ink channel 8 and the common liquid chamber 9 (FIG. 5).

Also by this Example, a good ink jet recording head could be prepared.

EXAMPLE 14

In this Example, an ink jet recording head was prepared in substantially the same manner as in Example 11.

However, as the material forming the photosensitive material layer 3, a solution comprising: Poly[4,5-bis(-trimethylsilyl)phthalaldehyde] (in the following structural formula $R_1$, $R_2$ are both $Si(CH_3)_3$).

SP-170 produced by Asahi Denka Kogyo: 0.2 part by weight;

Cyclohexanone: 50 parts by weight;

was used, and the dosage of the far UV-ray irradiated was made about 10 $mJ \cdot cm^{-2}$. Developing of the solid layer 5, heating during removal or heating in vacuum was conducted at 120° C.

Also by this Example, a good ink jet recording head could be prepared.

EXAMPLE 15

In this Example, an ink jet recording head was prepared in substantially the same manner as in Example 11.

However, as the material forming the photosensitive material layer 3, a solution comprising: Poly(4-chlorophthalaldehyde) (in the following structural formula $R_1$ is Cl, $R_2$ is H) .

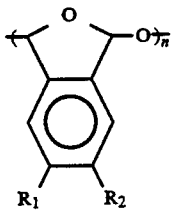

10 parts by weight 2,4-bis(trichloromethyl)-6-p-methoxy-styryl-S-triazine: 0.1 part by weight;

Cyclohexanone: 50 parts by weight;

was used, and the dosage of the UV-ray for patterning irradiated was made 15 $mJ \cdot cm^{-2}$. As the active energy ray curable material, KRM2410 produced by Asahi Denka Kogyo: 70 parts by weight;

Eporite 3002 produced by KyoeishaYushi Kagaku Kogyo: 30 parts by weight;

A-187 produced by Nippon Unicar: 5 parts by weight;

Triphenylsulfonium hexafluoroantimomate: 2 parts by weight;

which were mixed and defoamed were employed and the dosage of the far UV-ray for curing irradiated was made 10 $J \cdot cm^{-2}$. At this time, since the photoacid generating agent in the solid layer had substantially no sensitive wavelength region in the far UV-ray region, self-development of the solid layer 5 and the curing step of the active energy ray curable material was generated at all.

Subsequently, from the upper side of the substrate was irradiated a UV-ray of about 2 $J \cdot cm^{-2}$ and the solid layer 5 was removed by heating at 130° C. in vacuum, thereby forming the ink channel 8 and the common liquid chamber 9 (FIG. 5).

Also by this Example, a good ink jet recording head could be prepared.

Figure 17:
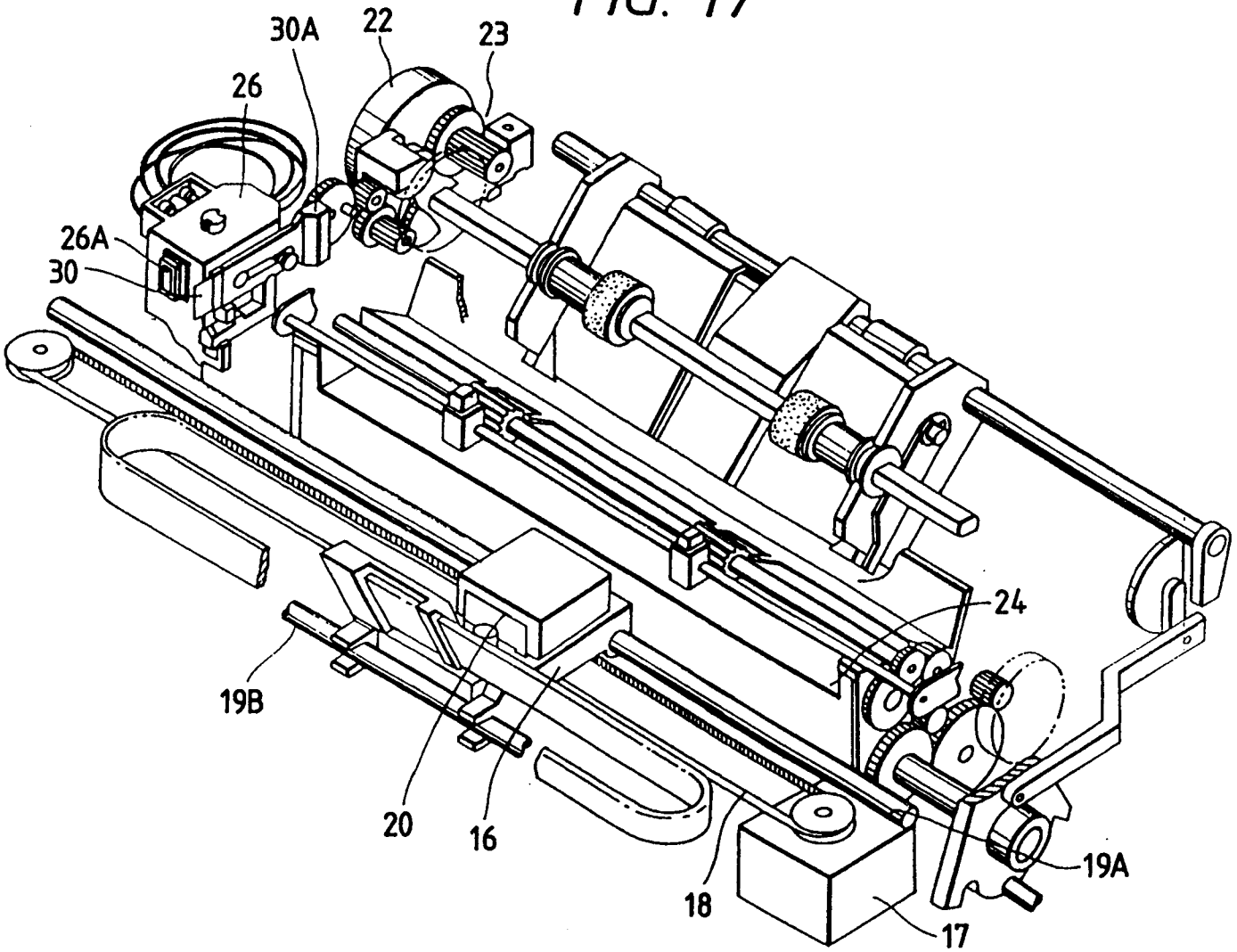
FIG. 17 is a perspective view showing an example of ink jet recording device having the ink jet recording head prepared mounted thereon.

FIG. 17 is a perspective view of appearance showing an example of an ink jet recording apparatus (IJRA) having the ink jet recording head prepared according to the preparation method of the present invention mounted as the ink jet head cartridge (IJC).

In FIG. 17, 20 is an ink jet head cartridge (IJC), equipped with a discharging outlet for performing ink discharging as opposed to the recording surface of the recording paper delivered onto the platen 24. 16 is a carriage HC for holding the IJC 20, which is connected to a part of the driving belt 18 for driving the driving force of the driving motor 17, and by making it slidable with 2 guide shafts 19A and 19B arranged in parallel to each other, a reciprocal movement over the whole width of the recording paper of the IJC 20 becomes possible.

26 is a head restoration device, and is arranged at one end of the movement route of the IJC 20, for example, at the position opposed to the home position. By the driving force of the motor 22 through the transmission mechanism 23, the head restoration device 26 is actuated to effect capping of the IJC 20. In connection with the capping of the IJC 20, by the cap portion 26A of the head restoration device 26, ink suction by a suitable suction means provided within the head restoration means 26 or ink pressure delivery by a suitable pressurization means provided within the ink feeding route to the IJC 20 is performed to discharge compulsorily the ink through the discharging outlet, thereby performing discharging restoration treatment such as removal of the thickened ink, etc. internally of the discharging outlet. Also, by applying capping on completion of recording, etc., IJC can be protected.

30 is a blade as the wiping member, which is arranged at the side surface of the heat restoration device 26 and is formed of, for example, a silicone rubber. The blade 31 is held in the cantilever form at the blade holding member 31A, and similarly as the head restoration device 26, actuated by the motor 22 and the transmission mechanism 23, whereby engagement with the discharging outlet surface of the IJC 20 becomes possible. By this at adequate timing in the recording actuation of the IJC 20, or after the discharging restoration treatment by use of the head restoration device 26, the blade 31 is protruded into the movement route of the IJC 20, whereby dew formation, wetting or dust, etc. at the discharging outlet surface of the IJC 20 are wiped off as accompanied with the movement actuation of the IJC 20.

The present invention brings about excellent effects in the recording head, recording apparatus of the system which discharges ink by utilizing heat energy particularly among the ink jet recording system.

As to its representative constitution and principle, for example, they should be preferably performed by use of the basic principle disclosed in, for example U.S. Pat.

No. 4,723,129 and No. 4,740,796. This system is applicable to both the on-demand type, the continuous type, and effective because by applying at least one driving signal which gives an abrupt temperature elevation exceeding the neucleus boiling corresponding to the recording information to the electro-thermal transducer arranged corresponding to the sheet or the liquid channel where the liquid (ink) is maintained, a heat energy is generated at the electrothermal transducer to effect film boiling at the heat acting surface of the recording head, whereby consequently bubbles within the liquid (ink) corresponding one by one to the driving signal can be formed. By growth, shrinkage of such bubbles, through the opening for discharging, the liquid (ink) is discharged to form at least one droplet. When the driving signal is made in pulse shape, growth and shrinkage of the bubbles can be effected instantly adequately, whereby discharging of the liquid (ink) excellent in response can be particularly accomplished more preferably. As such pulse-shaped driving signal, those as disclosed in U.S. Pat. No. 4,463,359 and No. 4,345,262 are suitable. Further excellent recording can be performed by employment of the conditions described in U.S. Pat. No. 4,313,124 concerning the temperature elevation ratio of the above heat acting surface.

Concerning the constitution of the above head, in addition to the combined constitution of the discharging outlet, liquid channel, an electro-thermal transducer (linear liquid channel or light angle liquid channel) as disclosed in the respective specifications as described above, the constitution by use of U.S. Pat. No. 4,558,333 and No. 4,459,600 disclosing the constitution in which the heat acting portion is arranged in the bent region is also included within the present invention. In addition, the present invention is also effective as the constitution based on Japanese Patent Laid-open No. 59-123670 disclosing the constitution having the common slit as the discharging portion of the electro-thermal transducer to a plurality of electro-thermal transducers or Japanese Patent Laid-open No. 59-138461 disclosing the constitution having the openings for absorbing the pressure wave of the heat energy corresponding to the discharging portion.

Further, as the full line type recording head having the length corresponding to the width of the maximum recording medium which can be recorded by the recording apparatus, either with the constitution satisfying its length by a combination of plural recording heads as disclosed in the specifications as described above or with the constitution as one recording head integrally formed, the present invention can exhibit further effectively the effect as described above.

In addition, the present invention is effective also in the case of using a recording head of the chip type freely exchangeable which enables electrical connection with the main apparatus or feeding of the ink from the main apparatus by being mounted on the main apparatus, or the recording head of the cartridge type which is provided integrally on the recording head itself.

Also, addition of a restoration means, a preliminary auxiliary means to the above head which is provided as the constitution of the recording apparatus of the present invention is preferable, because the effects of the present invention can be further stabilized. To mention these specifically, the capping means, the cleaning means, the pressurization or suction means for the above head, preliminary heating means by electro-thermal transducer or a combination of heating elements separate from this, and practice of preliminary discharging mode which performs discharging separate from recording are also effective for performing stable recording. Further, as the recording mode of the recording apparatus, the present invention is extremely effective not only for the recording mode of only black color, etc. as the main color, but also for the apparatus equipped with at least one full color with mixed colors of different colors or color mixing, which may either constitute integrally the recording head or may be a combination of a plurality of recording heads.

In the Examples of the present invention described above, description is made by use of a liquid ink, but in the present invention even an ink which solid at room temperature, or an ink which becomes softened at room temperature can be used. In the ink jet apparatus as described above, since the ink is controlled in temperature within the range from 30° C. to 70° C. so that the viscosity of the ink may be within stable discharging, any ink which is liquid during imparting recording signal during use may be employed. In addition, use of an ink having the properties of being liquified for the first time by heat energy is also applicable to the present invention, such as by preventing temperature elevation with the heat energy positively by using it as the energy for the state change from the solid state to the liquid state or by using the ink solidified under the state left to stand for the purpose of preventing evaporation of the solvent, anyway permitting the ink liquified to be discharged as the ink liquid by imparting heat energy corresponding to the recording signal or as the ink which begins to be solidified when reaching the recording medium etc.

In such case, the ink can be made the form as opposed to the electro-thermal transducer under the state held as a liquid or a solid material in the porous sheet concavity or thru-hole as described in Japanese Patent Laid-open No. 54-56847 or 60-71260. In the present invention, most effective for the respective inks as described above i-s one which practices the film boiling system as described above.

As is apparent from the above description, according to the present invention, dry developing (or self-developing) materials which are volatilized, sublimated by only imparting light or heat, above all preferably dry developing (or self-developing) resin materials having photosensitivity are used as the material to be arranged corresponding to the pattern of the ink channel. Accordingly, developing and removal can be performed without use of a bath agent.

More specifically, according to the present invention, large scale preparation apparatus such as developing apparatus or removing apparatus is no longer necessary, and also the steps can be more simplified, so that improvement of workability, productivity can be effected. Further, since no bath agent is required to be used, danger in production becomes smaller. Also, since dry developing (or self-developing) materials are employed, the width of choise of the materials for coating demanded in relationship with the bath agent becomes wider. In addition, there is no problem of swelling, etc. of the ink channel wall forming member, and also the problem of fine peel-off from the substrate can be solved. Therefore, an ink jet recording head with dimensional precision can be easily obtained.

Also, by applying water repellent treatment on the discharging outlet surface before removal of the solid layer, the water repellent agent will not enter internally of the discharging outlet, whereby an ink jet recording head of high precision can be obtained. Besides, since no bath agent is required to be used, function lowering of the water repellent agent which may sometimes occur with the bath agent can be prevented, whereby the width of choice of the water repellant agent demanded in relationship with the bath agent becomes wider.

What is claimed is:

1. A process for preparing an ink jet recording head, comprising:

the step for providing a first material which is volatilized by imparting an active energy in a layer on a substrate;

the step for patterning the layer of said first material by imparting said active energy to the layer of said first material corresponding to the pattern of ink channels communicated to the discharging outlet which discharges ink;

the step for providing a second material so as to cover the layer of said first material shaped in the pattern formed by said step; and the step for forming said ink channels by volatilization of the layer of said pattern shaped first material coated with said second material by imparting said active energy.

2. A process for preparing an ink jet recording head according to claim 1, wherein said first material contains at least one of nitrocellulose, polysilane compounds and poly(o-phthalaldehyde).

3. A process for preparing an ink jet recording head according to claim 1, wherein said first material contains at least one of onium salts, polyhalogen compounds and nitrobenzyl sulfonate as the optical acid generating agent which generates an acid by irradiation of light.

4. A process for preparingan ink jet recording head according to claim 1, wherein the step for providing said second material is practiced by transfer molding of said second material.

5. A process for preparing an ink jet recording head according to claim 1, having the step for applying a liquid repellent treatment on the surface where said discharging outlet is provided after the step of providing said second material and before the step of forming said ink channels.

6. A process for preparing an ink jet recording head according to claim 5, wherein in the step for forming said ink channels, the liquid repellent treatment agent attached on the site corresponding to said discharging outlet is removed together with the layer of said pattern-shaped first material.

7. A process for preparing an ink jet recording head, comprising:

the step for providing a first material which is volatilized by imparting an active energy and heat in a layer on a substrate;

the step for patterning the layer of said first material by imparting said active energy to the layer of said first material corresponding to the pattern of an ink channel communicated to the discharging outlet for discharging ink;

the step for providing a second material so as to cover the layer of said first material shaped in a pattern formed by said step; and the step for forming said ink channel by volatilization of the layer of said pattern-shaped first material coated with said second material by imparting said active energy and said heat.

8. A process for preparing an ink jet recording head according to claim 7, wherein said first material contains a polycarbonate.

9. A process for preparing an ink jet recording head according to claim 7, wherein said first material contains a poly (olefinsulfone) .

10. A process for preparing an ink jet recording head according to claim 7, wherein said first material contains at least one of poly(4-chlorophthalaldehyde) and poly(4-bromophthalaldehyde).

11. A process for preparing an ink jet recording head according to claim 7, wherein said first material contains at least one of poly(4-trimethylsilylphthalaldehyde) and poly[4,5-bis(trimethylsilyl)phthalaldehyde].

12. A process for preparing an ink jet recording head according to claim 7, wherein said first material contains at least one of onium salts, polyhalogen compounds and nitrobenzyl sulfonate as the optical acid generating agent which generates an acid by irradiation of light.

13. A process for preparing an ink jet recording head according to claim 7 wherein the step for providing said second material is practiced by transfer molding of said second material.

14. A process for preparing an ink jet recording head according to claim 7 having the step of applying a liquid repellent treatment on the surface where said discharging outlet is provided after the step of providing said second material and before forming said ink channel.

15. A process for preparing an ink jet recording head according to claim 14, wherein in the step of forming said ink channel, the liquid treatment agent attached on the site corresponding to said discharging outlet is removed together with the layer of said pattern-shaped first material.

* * * * *

UNITED STATES PATENT AND TRADEMARK OFFICE

CERTIFICATE OF CORRECTION

PATENT NO. : 5,334,999

DATED : August 2, 1994

INVENTOR(S) : AKIO KASHIWAZASKI, ET AL.

It is certified that error appears in the above-identified patent and that said Letters Patent is hereby corrected as shown below:

TITLE PAGE

[30] Foreign Application Priority Data

"Jul. 5, 1991 [JP] Japan ..... 2-165410" should read --July 5, 1991 [JP] Japan ..... 3-165410--.

[56] References Cited

Foreign Patent Documents, "1280565 1/1990 Japan" should read --1-280565 11/89 Japan--.

Other Publications, Page 2, M.W. Geis et al.", Subicrometer" should read --Submicrometer--.

COLUMN 1

Line 34, "4,657,631)." should read --4,657,631):--

COLUMN 2

Line 17, "may be" should read --may--.
Line 23, "be sometimes" should read --sometimes be--.
Line 26, "ink" should read --ink,--.

COLUMN 5

Line 6, "given" should be deleted.

COLUMN 7

Line 26, "(o phthalaldehyde)" should read --o-phthalaldehyde)--.
Line 61, "no" should be deleted.

UNITED STATES PATENT AND TRADEMARK OFFICE

CERTIFICATE OF CORRECTION

PATENT NO. : 5,334,999

DATED : August 2, 1994

INVENTOR(S) : AKIO KASHIWAZASKI, ET AL.

It is certified that error appears in the above-identified patent and that said Letters Patent is hereby corrected as shown below:

COLUMN 8

Line 27, "phthaalaldehyde]" should read --phthalaldehyde)--.

COLUMN 12

Line 40, "constitutes" should read --constitutes,--.
Line 41, "respectively" should read --respectively,--.
Line 42, "to" should be deleted.
Line 64, "is discharged" should be deleted.

COLUMN 13

Line 40, "surface 121" should read --surface 121a--.

COLUMN 14

Line 37, "reelamine" should read --melamine--.

COLUMN 15

Line 26, "minutes" should read --10 minutes--.
Line 53, "a" should read --an--.
Line 62, "con, non" should read --common--.
Line 64, "photosensitive-material" should read --photosensitive material--.
Line 66, "con,non" should read --common--.

COLUMN 16

Line 25, "confirmed at all." should read --confirmed.--.
Line 41, "15 pm." should read --15 μm.--.

UNITED STATES PATENT AND TRADEMARK OFFICE

CERTIFICATE OF CORRECTION

PATENT NO. : 5,334,999

DATED : August 2, 1994

INVENTOR(S) : AKIO KASHIWAZASKI, ET AL.

It is certified that error appears in the above-identified patent and that said Letters Patent is hereby corrected as shown below:

COLUMN 17

Line 7, "accurred." should read --occurred.--.
Line 24, "con, non" should read --common--.
Line 26, "there existed" should be deleted.
Line 28, "ac-" should read --oc- --.
Line 54, "on-the" should read --on the--.

COLUMN 18

Line 2, "con, non" should read --common--.
Line 9, "accured" shoud read --occurred--.
Line 15, "comprising," should read --comprising:--.
Line 56, "photosensitire" should read --photosensitive--.

COLUMN 19

Line 10, "con, non" should read --common--.
Line 47, "by a" should read --by an--.

COLUMN 20

Line 1, "weight-" should read --weight--.
Line 2, ")" should be deleted.
Line 3, "Poiydine-N" should read --Polydine-N--.
Line 56, "vacuu," should read --vacuum--.

COLUMN 21

Line 36, "KRM42410" should read --KRM2410--.

UNITED STATES PATENT AND TRADEMARK OFFICE

CERTIFICATE OF CORRECTION

PATENT NO. : 5,334,999

DATED : August 2, 1994

INVENTOR(S) : AKIO KASHIWAZASKI, ET AL.

It is certified that error appears in the above-identified patent and that said Letters Patent is hereby corrected as shown below:

COLUMN 22

Line 60, "con, non" should read --common--.

COLUMN 23

Line 23, "Si(CH3)3)." should read --Si(CH3)3).

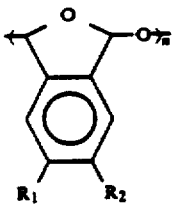

10 parts by weight

--

COLUMN 25

Line 5, "neucleus" should read --nucleus--.

UNITED STATES PATENT AND TRADEMARK OFFICE

CERTIFICATE OF CORRECTION

PATENT NO. : 5,334,999

DATED : August 2, 1994

INVENTOR(S) : AKIO KASHIWAZASKI, ET AL.

It is certified that error appears in the above-identified patent and that said Letters Patent is hereby corrected as shown below:

COLUMN 26

Line 14, "which" should read --which is--.
Line 40, "i-s" should read --is--.
Line 59, "choise" should read --choice--.

COLUMN 27

Line 6, "repellant" should read --repellent--.
Line 24, "pattern shaped" should read --pattern-shaped--.
Line 38, "preparingan" should read --preparing an--.

COLUMN 28

Line 39, "claim 7" should read --claim 7,--.
Line 43, "claim 7" should read --claim 7,--.

Signed and Sealed this

Second Day of May, 1995

Bruce Lehman

*Attest:*

BRUCE LEHMAN

*Attesting Officer*

*Commissioner of Patents and Trademarks*